United States Patent [19]

Kirigaya et al.

[11] 3,998,987

[45] Dec. 21, 1976

[54] ELECTROSTATIC RECORDING ELEMENT

[75] Inventors: Kiichi Kirigaya; Makoto Ogiwara; Syosaku Koseki; Toshiho Yamaguchi, all of Shizuoka, Japan

[73] Assignee: Tomoegawa Paper Mfg. Co., Ltd., Tokyo, Japan

[22] Filed: Jan. 23, 1975

[21] Appl. No.: 543,535

Related U.S. Application Data

[63] Continuation of Ser. No. 305,275, Nov. 10, 1972.

[30] Foreign Application Priority Data

May 20, 1971 Japan ..... 46-34251
Nov. 13, 1971 Japan ..... 46-90932

[52] U.S. Cl. ..... 428/330; 427/12; 427/13; 427/121; 427/209; 427/377; 428/383; 428/522; 428/537; 428/539; 428/342; 428/511

[51] Int. Cl.[2] ..... B44C 1/00; B44D 1/10

[58] Field of Search ..... 96/1, 1.5; 427/121, 427/19, 209, 377, 12, 13; 428/330, 340, 342, 511, 383, 522, 537, 539

[56] References Cited

UNITED STATES PATENTS

| | | | |
|---|---|---|---|
| 3,110,621 | 11/1963 | Doggett et al. | 427/121 X |
| 3,554,742 | 1/1971 | Gramiza | 96/1.5 |
| 3,640,708 | 2/1972 | Humphriss | 96/1.5 |
| 3,745,005 | 7/1973 | Yoerger | 96/1.5 |
| 3,759,744 | 9/1973 | Schliesman | 428/330 |

*Primary Examiner*—Edward C. Kimlin
*Attorney, Agent, or Firm*—Finnegan, Henderson, Farabor & Garrett

[57] ABSTRACT

An electrostatic recording element comprising a conductive layer and a surface layer electrostatically chargeable upon application of an electric field, said surface consisting of an upper recording layer and a lower insulating layer, and said recording layer containing highly insulating hydrophobic resin and an elevated amount of inorganic or organic pigment whereas said insulating layer either consisting solely of highly insulating hydrophobic resin or containing only a small amount of said pigment together with said resin which is scribable or stampable with water-soluble ink without deteriorating the recording characteristics and is at the same time capable or preventing fingerprints, and which can further be utilized as a lithographic printing plate.

3 Claims, 3 Drawing Figures

INVENTOR

ELECTROSTATIC RECORDING ELEMENT

This is a continuation, division of application Ser. No. 305,275, filed Nov. 10, 1972.

This invention relates to a recording element adapted for use in an electrostatic recording process for directly forming electrostatic latent image by applying a high electric field, and particularly to an electrostatic recording element which is scribable or stampable with water-soluble ink without deteriorating the recording characteristics and is at the same time capable of preventing fingerprints, and which can further be utilized as a lithographic printing plate.

Conventional electrostatic recording elements employed practically can be roughly classified into (1) those composed of a substrate with volume resistance of $10^5$–$10^{11}$ ohm/cm$^2$ and a layer of non-photosensitive dielectric material thereon provided with a surface resistivity of $10^{12}$–$10^{16}$ ohm and (2) an insulating substrate provided thereon with a conductive layer with surface resistivity of $10^5$–$10^{11}$ ohm and a layer of non-photosensitive dielectric material provided on said conductive layer. Sain non-photosensitive dielectric layer forming surface recording layer is generally composed of a highly insulating hydrophobic resin provided with a surface resistivity of $10^{12}$–$10^{16}$ ohm in order to obtain a recording image stable against atmospheric humidity, and such recording layer is therefore not scribable nor stampable with water-soluble ink. The applications of such recording elements are consequently subject to limitation because of such property. Besides such recording elements are accompanied by a drawback that fingerprints eventually formed on the surface recording layer in manual handling of such recording element prior to the recording hinder the formation of electrostatic latent image on such fingerprints. Addition of pigments to said highly insulating hydrophobic resins which has been tried to obtain mat finished surface thereby improving scribability or stampability has proved not so effective as to become comparable with plain paper and is scarcely effective for preventing fingerprints. Further, increase in the pigment concentration in the surface recording layer in order to enhance the effects mentioned above will result in the lowered surface resistivity of said layer which eventually becomes unable to produce recordings stable against atmospheric humidity. Maximum limit of such addition of pigment is 40 parts by weight with respect to 100 parts by weight of resin even in case of highly insulative resin relatively stable against atmospheric humidity and within a wide range of conditions though said limit is variable to some extent depending on the kinds of the pigment used, and the addition of such amount is far from satisfactory for improving scribability or stampability as well as preventing fingerprints.

Thus the present invention is to provide an electrostatic recording element which is capable of obtaining electrostatic recording practically without being affected by the change in atmospheric moisture and simultaneously is provided with scribability and stampability comparable with those of plain paper, and which is further capable of preventing the adhesion of fingerprints, said element comprising a substrate subjected to conductive treatment and a surface layer of two-layer structure of which one not facing said substrate is composed of highly insulating hydrophobic resin and an elevated amount of inorganic or organic pigment while the other facing said substrate is composed either solely of highly insulative hydrophobic resin or of said resin added with small amount of such pigment.

The present invention will be clarified by the following description with particular reference to the attached drawings.

The uppermost layer *a* is essentially composed of at least a binder material of highly insulating hydrophobic resin such as vinyl acetate resin, vinyl chloride resin, vinyldene chloride resin, acrylic resin, silicone resin, vinyl chloride-vinyl acetate copolymer, and methylmethacrylateethyl acrylate copolymer and at least an inorganic or organic pigment, preferably at least a non-photosensitive pigment such as titanium oxide, calcium carbonate, lithopone, clay, talc, silica or starch in an amount from 30 to 1500 parts, by weight, with respect to 100 parts by weight of said binder material. Although larger addition of pigment is more effective in improving the scribability and stampability and preventing the fingerprints, the amount of pigment should not exceed 1500 parts, preferably 1000 parts by weight with respect to 100 parts by weight of said resin since an excessive amount adversely affects the charging characteristics and coating strength to give an impractical element. Though photosensitive pigments are also usable for this purpose, the amount of addition thereof is subject to limitation because of rapid decrease in electric resistance when exposed to light. Zinc oxide, for example, can only be used as much as 100 parts by weight with respect to 100 parts by weight of resin.

The next layer *b* is a highly insulating layer provided with a surface resistivity higher than that of said layer *a* and is composed either solely of the highly insulating hydrophobic resin or of said resin and 30 parts by weight or less of an inorganic or organic pigment with respect to 100 parts by weight of said resin. The objects of the present invention cannot be achieved because of the volume resistance lower than $10^{10}$ ohm/cm$^2$ when the amount of pigment exceeds 30 parts.

The conductive layer *c*, with surface resistivity of $10^5$–$10^{11}$ ohm, is composed of conventionally known material of low electric resistance such as polymeric vinylbenzyl trimethyl ammonium.

The lowermost substrate layer *d* is composed of a sheet of paper or plastics.

Figure 1:
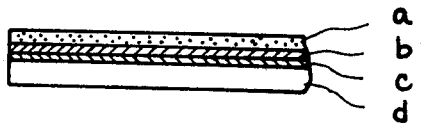
FIG. 1 shows the structure of the recording element according to the present invention in which the surface layer consists of two layers; layer *a* and layer *b*.
Figure 2:
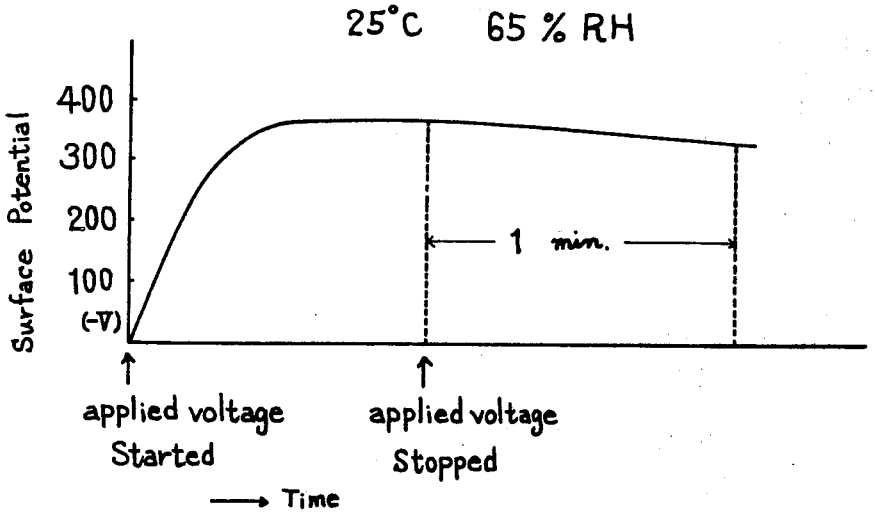
FIG. 2 shows the charging characteristics of an electrostatic recording element prepared according to this invention.
Figure 3:
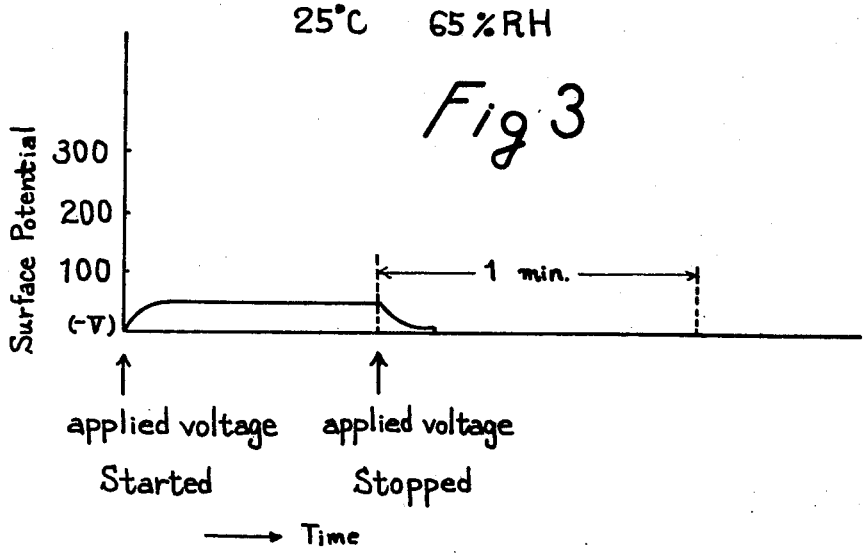
FIG. 3 shows the charging characteristics of an electrostatic recording element prepared according to the prior art.

The functions of thus composed recording element of the present invention are explained with reference to FIGS. 2 and 3. FIG. 2 shows the charging characteristics of the electrostatic recording element prepared according to the example 1 of the present invention, and indicates the relationship between the surface charge potential and time after electrostatic charging with a corona discharge of −6000V. Said figure clearly shows that the charge potential is sufficiently high for obtaining stable image with scarce decay thereafter, in sharp contrast to FIG. 3 showing the charging characteristics similarly with a corona discharge of −6000V on an electrostatic recording element provided, as a reference example, with a single recording layer consisting of 100 parts by weight of acrylic resin and 50 parts by weight of titanium oxide on a conductive substrate. FIG. 3 shows that said reference example no longer is capable of forming stable image because of lowered charge amount and rapid decay of charge. This difference can presumably be attributable to the fact that, in the present invention, the electrostatic charge subject to leaking due to volume resistance lower than $10^{10}$ ohm/cm$^2$ in the layer *a* of elevated pigment content is maintained by the insertion of a highly insulating layer *b* under said layer *a* whereas in the conventional electrostatic recording element the electrostatic charge is apt to leak as the recording layer of elevated pigment content is directly contacting the conductive layer provided thereunder.

Thus, according to the present invention, because of the presence of a highly insulating layer *b* under said layer *a*, a pigment content in said layer *a* much higher than in the recording layer of conventional recording element is permissible without any detrimental effect on the recording characteristics and simultaneously enables to significantly obtain the scribability and stampability comparable with those of plain paper. Also it is confirmed that such recording layer rich in pigment can effectively prevent the adhesion of fingerprints which has been regarded as the fatal drawback of the conventional electrostatic recording element.

Furthermore the electrostatic recording element according to the present invention can be utilized as a lithographic printing plate in the electrostatic recording processes, which is characterized by rapid desensitizing treatment and sufficient length of run. The surface layer of the lithographic printing plate of this kind generally requires an elevated content of inorganic pigment in order to enhance the hydrophilicity of non-image portions, but such elevated content has not been realizable in the electrostatic recording processes because of leak of surface charge into the substrate as explained above. On the contrary, according to the present invention, the presence of highly insulating layer *b* prevents said leak and enables the elevated content of pigment in the uppermost layer *a* which in turn enables to realize satisfactory hydrophilic treatment. Besides the multi-layer structure consisting of the layer *a* using hydrophobic resin as the binder and the layer *b* thereunder using a resin of stronger hydrophobic character provides an elevated length of run. Furthermore, according to the present invention, a lithographic printing plate of higher quality can be obtained by appropriate choice of pigment to be used. The pigment to be employed in this invention is preferably non-photosensitive as already explained, and particularly preferably consists of beryllium oxide or magnesium oxide as they show scarce decrease in electric resistance when exposed to light and is capable of forming strong hydrophilic film. The reason for such excellent characteristics of said inorganic pigments, though being not fully clarified, seems attributable to the fact that they have stable atomic structure, are highly insulative and non-photosensitive, and are capable of forming a strong hydrophilic film by stable chemical bonding with solution for hydrophilic treatment as they are soluble in acid and alkali. Such pigment can be employed either solely, or in combination with other pigments of less sensitive to light such as clay or titanium oxide in order to economize the cost.

The present invention will further be clarified by the following examples.

EXAMPLE 1

A sheet of paper of 50 $\mu$ thickness was coated with aqueous solution of cationic poly electrolyte (Dow Chemical: ECR-34) to obtain a conductive layer of 3 $\mu$ thickness, further coated with a copolymer resin paint chiefly consisting of methyl methacrylate by means of a roll coater with a coating weight of 40 g/m$^2$, and further coated with a paint containing 100 parts by weight of vinyl acetate-vinyl chloride copolymer and 200 parts by weight of titanium oxide by means of a roll coater to form a recording layer with a coating weight of 45 g/m$^2$ thereby obtaining an electrostatic recording element. The electrostatic recording element thus obtained showed excellent image when recorded with an electric potential of 1000 V for a duration of 50 $\mu$s. Also said electrostatic recording element showed excellent scribability and stampability and apparent improvement in the prevention of fingerprints.

EXAMPLE 2

A sheet of paper of 60 $\mu$ was coated with aqueous solution of anionic poly electrolyte (Tomoegawa Paper Mfg. Co., Ltd. Oligo-Z: polystyrene sulfonate) with a coating weight of 3 g/m$^2$, then coated with a paint consisting of 100 parts by weight of vinyl acetate-vinyl chloride copolymer resin and 5 parts by weight of lithopon pigment with a coating weight of 40 g/m$^2$ and further coated with a paint consisting of 100 parts by weight of acrylic resin, 200 parts by weight of clay and 300 parts by weight of calcium carbonate with a coating weight of 40 g/m$^2$ to obtain an electrostatic recording element. The recording element thus obtained showed very clear and stable recording under the same conditions as the first example. Also said recording element showed excellent scribability and stampability, and obvious improvement in the prevention of fingerprints.

EXAMPLE 3

A sheet of paper of 100 $\mu$ thickness was coated with aqueous solution anionic poly electrolyte with a coating weight of 35 g/m$^2$ to obtain a low-resistance layer, then coated with acrylic resin with a coating weight of 4 g/m$^2$ and further coated with a paint consisting of 100 parts by weight of acrylic resin and 700 parts by weight of potato starch with a coating weight of 35 g/m$^2$ to obtain an electrostatic recording element. The recording element thus obtained showed similar characteristics as in the examples 1 and 2.

EXAMPLE 4

A sheet of paper of 120 g/m$^2$ previously treated with aqueous solution of sodium alginate so as to reduce the volume resistance to a value not exceeding $10^8$ ohm/cm$^2$ was coated with 20% solution of polyvinyl acetate in toluene so as to obtain a coating thickness of ca 3 $\mu$ after drying, and further coated with a paint prepared by blending 100 parts by weight of powdered magnesium oxide, 30 parts by weight of polyvinyl acetate and 200 parts by weight of toluene in a ball mill for 24 hours so as to obtain a coating thickness of 4 $\mu$ after drying thereby obtaining an element for lithographic printing plate for electrostatic plate making process.

A printing plate was prepared by applying an electric field of ca. 1000 V to said element, forming imagewise electrostatic latent image thereon, developing said image with a developer and fixing thus obtained developed image. Printing on an offset press with thus prepared printing plate, after the printing surface being treated with phosphate solution, provided 500 copies of excellent quality, and said plate was still usable for printing.

EXAMPLE 5

A film of polyethylene of 40 $\mu$ thickness was coated with methanolic solution of vinylbenzyl trimethyl ammonium chloride to obtain a substrate with a surface resistivity of ca. $10^6$ ohm, which was then coated with 20% solution of polyvinyl acetate in toluene so as to obtain a coating thickness of ca. 3 $\mu$ and further coated with a paint prepared by blending 100 parts by weight of powdered beryllium oxide, 40 parts by weight of vinyl chloride-vinyl acetate (86/14) copolymer and 200 parts by weight of toluene in a ball mill for 24 hours so as to obtain a coating thickness of 4 $\mu$ after drying thereby obtaining an element for electrostatic lithographic printing plate.

Said element provided, on offset press in a manner similar to that in example 4, more than 1000 copies of printings, and the length of run proved to be superior to that in example 4.

EXAMPLE 6

A sheet of quality paper of 120 g/m$^2$ previously treated with aqueous solution of polystyrene sulfonates so as to reduce the volume resistance thereof to a value not exceeding $10^8$ ohm/cm was coated 20% solution of methyl methacrylate-ethyl acrylate copolymer in toluene added with 30 parts of clay with respect to the solid of said copolymer so as to obtain a coating thickness of ca. 3 $\mu$ after drying, and further coated with a paint prepared by blending 100 parts by weight of powdered magnesium oxide, 30 parts by weight of titanium oxide, 40 parts by weight of polyvinyl acetate and 60 parts by weight of toluene in a ball mill for 24 hours so as to obtain a coating thickness of 4 $\mu$ after drying thereby obtaining an element for electrostatic process lithographic printing plate.

Said element thus obtained provided, on an offset press in a manner similar to that in the example 4, 300 copies of excellent printings and was still usable.

EXAMPLE 7

The conductive substrate employed in example 6 was coated with acrylic resin with a coating weight of 4 g/m$^2$, and further coated with a paint consisting of 100 parts by weight of styrene resin and 100 parts by weight of photosensitive zinc oxide with a coating weight of 3.5 g/m$^2$ thereby obtaining an electrostatic recording element. The recording element thus obtained was subjected to recording in a manner similar to that in the example 4 to obtain a very clear and stable image. The recording thus obtained was subjected to offset printing in a manner similar to that in the example 4 to provide 400 copies of satisfactory printings, and the element was still usable for printing. Also said recording element showed excellent scribability and stampability and evident effect on the prevention of fingerprints.

On the other hand an electrostatic recording element prepared by employing 150 parts instead of 100 parts of zinc oxide in the uppermost layer with respect to 100 parts of styrene resin provided, in a recording process of example 4, a recording of significantly lowered image density and was therefore unusable.

What is claimed is:

1. An electrostatic recording element having a conductive layer and a surface layer electrostatically chargeable upon application of an electric field, said surface layer consisting of an upper recording layer and a lower insulating layer adjacent the conductive layer, said recording layer comprising an insulating hydrophobic resin and a non-photosensitive, inorganic pigment in a ratio of from about 100 to about 1000 parts by weight per 100 parts by weight of said resin, and said lower insulating layer comprising an insulating hydrophobic resin and a non-photosensitive, inorganic pigment in a ratio of 0 up to no more than 30 parts by weight per 100 parts by weight of said resin, said non-photosensitive, inorganic pigment in both the recording layer and the insulating layer being selected from the group consisting of calcium carbonate, lithopone, clay, talc, silica, starch, beryllium oxide, and magnesium oxide, and said insulating hydrophobic resin in both the recording layer and the insulating layer being selected from the group consisting of polyvinyl acetate, polyvinyl chloride, polyvinylidene chloride, polyacrylate, polysiloxane, polystyrene, vinyl chloride-vinyl acetate copolymer, and methyl methacrylateethyl acrylate copolymer.

2. An electrostatic recording element according to claim 1, wherein said non-photosensitive pigment is beryllium oxide.

3. An electrostatic recording element according to claim 1, wherein said non-photosensitive pigment is magnesium oxide.

* * * * *